US006051544A

United States Patent [19]

Lang et al.

[11] Patent Number: 6,051,544

[45] Date of Patent: Apr. 18, 2000

[54] GRANULAR SECONDARY ALKANESULFONATE

[75] Inventors: Frank-Peter Lang, Hattersheim; Helmut Kramer, Mainz; Roland Steinl, Kelsterbach, all of Germany

[73] Assignee: Clariant GmbH, Frankfurt, Germany

[21] Appl. No.: 09/009,229

[22] Filed: Jan. 20, 1998

[30] Foreign Application Priority Data

Jan. 21, 1997 [DE] Germany ..... 197 01 896

[51] Int. Cl.[7] ..... C11D 1/12; C11D 17/06

[52] U.S. Cl. ..... 510/446; 510/445; 510/357; 510/451

[58] Field of Search ..... 510/443, 444, 510/445, 495, 446, 447, 451, 357

[56] References Cited

FOREIGN PATENT DOCUMENTS

| | | |
|---|---|---|
| 3-10000 | 1/1991 | Japan . |
| 1477775 | 6/1977 | United Kingdom . |

*Primary Examiner*—Margaret Einsmann
*Attorney, Agent, or Firm*—Miles B. Dearth

[57] ABSTRACT

Granular secondary alkanesulfonate, essentially comprising finely divided, solid sec. alkanesulfonate and an additive. This granular sec. alkanesulfonate is obtained by grinding and mixing coarse sec. alkanesulfonate with an additive. The resulting alkanesulfonate can be used in solid detergent and cleaning product compositions or directly for producing extrudates, pressed articles or compacts.

6 Claims, No Drawings

GRANULAR SECONDARY ALKANESULFONATE

Secondary alkanesulfonates (SAS) have for many years been an important product group amongst anionic surfactants. Secondary alkanesulfonate in solid form does, however, have the undesired property that it is hygroscopic. Because of this property, solid SAS is only commercially available as pellets or flakes. In this coarse form, the hygroscopic property of the SAS is of no consequence. To prepare pulverulent, homogeneous detergent and cleaning product compositions, it is, however, necessary that all components are in finely divided form. However, finely divided SAS agglomerates as a result of its hygroscopic property, so that such pulverulent detergent and cleaning product compositions having a content of SAS do not remain in finely divided form. The use of SAS is thus essentially limited to liquid detergent and cleaning product compositions.

In the past there has been no lack of attempts to also facilitate the use of sec. alkanesulfonates in solid detergent and cleaning product compositions.

Thus, DE-A-2 415 159 describes a product which is obtained by spray drying an aqueous solution of alkanesulfonate and a carrier material. Suitable carrier materials in this context are essentially inorganic salts. The amount of these salts is quite high, being 50 to 95% by weight, based on the total amount of alkanesulfonate and carrier material.

WO 93/16164 describes the preparation of anionic surfactant salts by a spray neutralization process which involves spraying the anionic surfactants in their acid form together with aqueous solutions of bases. In this connection, suitable dust-binding auxiliaries may be added.

JP 89-142 999 discloses mixtures of alkanesulfonate and zeolites.

DE-A 2 745 691 describes SAS in powder form, the SAS containing no additives or anticaking agents of any kind.

The object of the present invention is to provide solid SAS in finely divided form which can be homogeneously incorporated directly as surfactant component into pulverulent detergent and cleaning product compositions without agglomeration, or which can be further processed in the usual manner together with components customary in detergent and cleaning product compositions to give solid extrudates, pressed articles or compacts.

The invention relates to a granular secondary alkanesulfonate, essentially comprising finely divided solid sec. alkanesulfonate and an additive.

The starting material is solid sec. alkanesulfonate, for example in the form of pellets (Hostapur® SAS 93) or in flake form. The alkyl group within this secondary alkanesulfonate can be either saturated or unsaturated, branched or linear and be unsubstituted or substituted by an hydroxyl group. The sulfo group can be at any desired position on the carbon chain, the primary methyl groups at the start and end of the chain having no sulfonate groups. The preferred secondary alkanesulfonates contain linear alkyl chains having about 9–25 carbon atoms, preferably 10 to 20, and, particularly preferably, about 13 to 17 carbon atoms. The cation is, for example, sodium, potassium, ammonium, mono-, di- or triethanolammonium, calcium or magnesium and mixtures thereof. Sodium is the preferred cation.

The alkanesulfonate according to the invention is prepared by grinding SAS in the form of pellets or flakes, as are usually formed in the production of solid SAS. In a first embodiment, this coarse SAS is thoroughly mixed with the additive prior to grinding and subsequently ground. In principle, all grinding apparatus is suitable for this purpose, for example impact mills, cutting mills, roller mills or air jet mills. Examples of impact mills are beater wheel mills with or without internals, pin mills and disintegraters, particularly ones having polished pins, universal mills having different operational elements, particularly having hammer-type operational elements. Particular preference is given to cutting mills, universal mills having cross-beaters and impact disk mills having screen cages and cross-beaters/turbines (e.g. impact disk mills of the PP/PPS type from Pallmann).

Alternatively, it is also possible to omit premixing of alkanesulfonate and additive, and to add the additive directly into the grinding apparatus at the same time as the alkanesulfonate. It is then also possible to use coarser materials having a diameter in the millimeter range, since these are automatically comminuted during grinding and are thoroughly mixed with the alkanesulfonate as a result of the mechanical action.

The mixture of alkanesulfonate and additive can be ground with cooling in order to dissipate the friction heat and aid the comminution process through low-temperature embrittlement. For this purpose, it is possible to cool the mill directly or, when the grinding process is continuous, the stream of air sucked in by the mill. It is also possible to precool the sec. alkanesulfonate or to add a refrigerant, for example dry ice, during the grinding process. In this comminution process, it must be ensured that moisture, in particular atmospheric moisture, is excluded after grinding (until the temperature of the product has reached that of the surroundings), e.g. by using suitable apparatus.

In a third variant, it is also possible firstly to grind the coarsely divided solid SAS, preferably with cooling, as described above, and then to mix the ground SAS with the additive.

In all the process variants described, the SAS and, in some instances, also the additive is ground to a particle size of from 0.1 to 3 mm, preferably from 0.5 to 2 mm.

For the purposes of this invention, suitable additives are a large number of compounds. They may be completely soluble in water, although they are preferably hydrophobic. In each case, it is a prerequisite that these additives are not hygroscopic. Moreover, preference is given to those additives which are already present in finely divided form from the start.

Examples of suitable additives are long chain fatty acids, in particular $C_{18}$–$C_{22}$ fatty acids, such as stearic acid and behenic acid, salts thereof, in particular the alkaline earth metal salts, fatty alcohols, polymers, such as high molecular weight polyethylene glycols, e.g. PEG 20,000, polyacrylates, for example ®Sokalan CP 5, celluloses and derivatives thereof, such as carboxymethylcellulose, methylcellulose, hydroxyethylcellulose, waxes, e.g. montan wax, paraffin waxes, ester waxes, polyolefin waxes, bentonites, e.g. ®Laundrosil DGA from Südchemie, magnesium oxide, chalk, kaolin, magnesium silicate, siliceous chalk, kieselguhr, silicas, talc and alkali metal and alkaline earth metal sulfates. Preferred additives include synthetic, finely divided, highly disperse silicas, e.g. pyrogenic silicas (®Aerosil grades from Degussa) and precipitated silicas, for example the commercial products ®Sident 12, Sident 12 DS, FK 160, FK 300 DS, FK 310, FK 320, FK 320 DS, FK 383 DS, FK 500 LS, FK 700, ®Sipernat 22, Sipernat 22S, Sipernat 30, Sipernat 50, Sipernat 50 S, Sipernat D 17, ®Ultrasil VN 2, Ultrasil VN 3, ®Wessalon and Wessalon S from Degussa. Such silicas are naturally hydrophilic, although hydrophobically modified silicas are also possible, such as Sipernat D 17 or Aerosil R 972.

The above additives are used in a concentration of from 0.1 to 10%, preferably from 0.5 to 5% and particularly preferably from 0.5 to 2%, based on sec. alkanesulfonate.

The resulting pulverulent or granular sec. alkanesulfonate can be incorporated directly as surfactant component into detergent and cleaning product compositions. Such pulverulent detergent and cleaning product compositions can be washing powders, stain removal salts, scouring agents and other solid mixtures. Another possibility is to convert the pulverulent or granular SAS according to the invention into solid extrudates, such as washing bars, bar soaps or toilet blocks, to give pressed articles, e.g. tablets, or compacts (rolls).

The sec. alkanesulfonate according to the invention can be used in the finished detergent and cleaning product formulations either alone or in combination with other surfactants.

The total concentration of surfactants, including the sec. alkanesulfonate according to the invention, can be from 1% to 99%, is preferably between 5% and 80%, and is particularly preferably between 5% and 40%.

The following surfactants can be combined, for example, together with the granular secondary alkanesulfonate according to the invention in detergent and cleaning product compositions.

Suitable anionic surfactants are sulfates, sulfonates, carboxylates, phosphates and mixtures thereof. Suitable cations in this context are alkali metals, for example sodium or potassium, or alkaline earth metals, for example calcium or magnesium, and also ammonium, substituted ammonium compounds, including mono-,di- or triethanolammonium cations, and mixtures thereof. The following types of anionic surfactant are of particular interest: alkyl ester sulfonates, alkyl sulfates, alkyl ether sulfates, alkylbenzenesulfonates, olefinsulfonates and soaps, as described below.

Alkyl ester sulfonates are, inter alia, linear esters of $C_8$–$C_{20}$ carboxylic acids (i.e. fatty acids) which are sulfonated using gaseous $SO_3$ as described in "The Journal of the American Oil Chemists Society" 52 (1975), pp. 323–329. Suitable starting materials are natural fats, such as tallow, coconut oil and palm oil, or else may be synthetic in nature. Preferred alkyl ester sulfonates, especially for detergent applications, are compounds of the formula

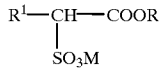

in which $R^1$ is a $C_8$–$C_{20}$ hydrocarbon radical, preferably alkyl, and R is a $C_1$–$C_6$ hydrocarbon radical, preferably alkyl. M is a cation which forms a water-soluble salt with the alkyl ester sulfonate. Suitable cations are sodium, potassium, lithium or ammonium cations, such as monoethanolamine, diethanolamine and triethanolamine. Preferably, $R^1$ is $C_{10}$–$C_{16}$-alkyl and R is methyl, ethyl or isopropyl. Particular preference is given to methyl ester sulfonates in which $R^1$ is $C_{10}$–$C_{16}$-alkyl.

Alkyl sulfates here are water-soluble salts or acids of the formula $ROSO_3M$, in which is a $C_{10}$–$C_{24}$ hydrocarbon radical, preferably an alkyl or hydroxyalkyl radical having a $C_{10}$–$C_{20}$-alkyl component, and, with particular preference, a $C_{12}$–$C_{18}$-alkyl or hydroxyalkyl radical. M is hydrogen or a cation, for example an alkali metal cation (e.g. sodium, potassium, lithium), or ammonium or substituted ammonium, for example methyl-, dimethyl- and trimethylammonium cations and quaternary ammonium cations, such as tetramethylammonium and dimethylpiperidinium cations and quaternary ammonium cations derived from alkylamines such as ethylamine, diethylamine, triethylamine and mixtures thereof. $C_{12}$–$C_{16}$-alkyl chains are preferred for low washing temperatures (e.g. below about 50° C.) and $C_{16}$–$C_{18}$-alkyl chains for higher washing temperatures (e.g. above about 50° C.).

Alkyl ether sulfates are water-soluble salts or acids of the formula $RO(A)_m\ SO_3M$, in which R is an unsubstituted $C_{10}$–$C_{24}$-alkyl or hydroxyalkyl radical, preferably a $C_{12}$–$C_{20}$-alkyl or hydroxyalkyl radical, and, with particular preference, a $C_{12}$–$C_{18}$-alkyl or hydroxyalkyl radical. A is an ethoxy or propoxy unit, m is a number greater than 0, preferably between about 0.5 and about 6 and, with particular preference, between about 0.5 and about 3, and M is a hydrogen atom or a cation such as sodium, potassium, lithium, calcium, magnesium, ammonium or a substituted ammonium cation, for example. Specific examples of substituted ammonium cations are methyl-, dimethyl-, trimethylammonium and quaternary ammonium cations such as tetramethylammonium and dimethylpiperidinium cations, and also those derived from alkylamines such as ethylamine, diethylamine, triethylamine or mixtures thereof. Examples are $C_{12}$ to $C_{18}$ fatty alcohol ether sulfates in which the content of EO is 1, 2, 2.5, 3 or 4 mol per mole of the fatty alcohol ether sulfate, and in which M is sodium or potassium.

Further suitable anionic surfactants are alkenyl- or alkylbenzenesulfonates. The alkenyl or alkyl group can be branched or linear and unsubstituted or substituted by a hydroxyl group. The preferred alkylbenzenesulfonates include linear alkyl chains having about 9 to 25 carbon atoms, preferably from about 10 to about 13 carbon atoms, and the cation is sodium, potassium, ammonium, mono-, di- or triethanolammonium, calcium or magnesium, and mixtures thereof. For mild surfactant systems magnesium is the preferred cation; for standard washing applications, on the other hand, it is sodium. The same applies to alkenylbenzenesulfonates.

The term anionic surfactants also includes olefinsulfonates obtained by sulfonation of $C_{12}$–$C_{24}$-, preferably $C_{14}$–$C_{16}$-α-olefins with sulfur trioxide, followed by neutralization. Owing to the preparation process, these olefinsulfonates may contain relatively small amounts of hydroxyalkanesulfonates and alkanedisulfonates. Specific mixtures of α-olefinsulfonates are described in U.S. Pat. No. 3,332,880.

Further preferred anionic surfactants are carboxylates, for example fatty acid soaps and comparable surfactants. The soaps can be saturated or unsaturated and can contain various substitutents, such as hydroxyl groups or α-sulfonate groups Preference is given to linear, saturated or unsaturated hydrocarbon radicals as the hydrophobic fraction with about 6 to about 30, preferably about 10 to about 18, carbon atoms.

Also suitable as anionic surfactants are salts of acylaminocarboxylic acids the acyl sarcosinates which are formed by reaction of fatty acid chlorides with sodium sarcosinate in an alkaline medium; fatty acid-protein condensation products obtained by reaction of fatty acid chlorides with oligopeptides; salts of alkylsulfamidocarboxylic acids; salts of alkyl and alkylaryl ether carboxylic acids; $C_8$–$C_{24}$ olefinsulfonates, sulfonated polycarboxylic acids prepared by sulfonating the pyrolysis products of alkaline earth metal citrates, as described for example in GB-1,082,179; alkyl glycerol sulfates, oleyl glycerol sulfates, alkylphenol ether sulfates, primary paraffinsulfonates, alkyl phosphates, alkyl ether phosphates, isethionates, such as acyl isethionates, N-acyltaurides, alkyl succinates, sulfosuccinates, monoesters of sulfosuccinates (especially saturated and unsaturated $C_{12}$–$C_{18}$ monoesters) and diesters of the sulfosuccinates (especially saturated and unsaturated $C_{12}$-$C_{18}$ diesters), acyl sarcosinates, sulfates of alkylpolysaccharides, such as sulfates of alkylpolyglycosides, branched primary alkyl sulfates and alkylpolyethoxycarboxylates such as those of the formula $RO(CH_2CH_2)_kCH_2COO^- M^+$, in which R is $C_8$- to $C_{22}$-alkyl, k is a number from 0 to 10 and M is a cation, resin acids or hydrogenated resin acids, such as rosin or hydrogenated rosin or tall oil resins and tall oil resin acids. Further examples are described in "Surface Active Agents and Detergents" (Vol. I and II, Schwartz, Perry and Berch).

Examples of suitable nonionic surfactants are the following compounds: Polyethylene, polypropylene and polybutylene oxide condensates of alkylphenols.

These compounds comprise the condensation products of alkylphenols having a $C_6$- to $C_{20}$-alkyl group, which can be either linear or branched, with alkene oxides. Preference is given to compounds having from about 5 to 25 mol of alkene oxide per mole of alkylphenol. Commercially available surfactants of this type are, for example, Igepal® CO-630, Triton® X-45, X-114, X-100 and X102, and the ®Arkopal-N grades from Clariant GmbH. These surfactants are termed alkylphenol alkoxylates, for example alkylphenol ethoxylates.

Condensation products of aliphatic alcohols with from about 1 to about 25 mol of ethylene oxide.

The alkyl chain of the aliphatic alcohols can be linear or branched, primary or secondary, and contains in general about 8 to about 22 carbon atoms. Particular preference is given to the condensation products of $C_{10}$ to $C_{20}$ alcohols having from about 2 to about 18 mol of ethylene oxide per mole of alcohol. The alkyl chain can be saturated or unsaturated. The alcohol ethoxylates can have a narrow (narrow range ethoxylates) or a broad (broad range ethoxylates) homologous distribution of the ethylene oxide. Examples of commercially available nonionic surfactants of this type are Teritol® 15-S-9 (condensation product of a linear secondary $C_{11}$–$C_{15}$ alcohol with 9 mol of ethylene oxide), Tergitol® 24-L-NMW (condensation product of a linear primary $C_{12}$–$C_{14}$ alcohol with 6 mol of ethylene oxide, with a narrow molar weight distribution). Also part of this class of product are the Genapol® grades from Clariant GmbH.

Condensation products of ethylene oxide with a hydrophobic base, formed by condensation of propylene oxide with propylene glycol.

The hydrophobic part of these compounds preferably has a molecular weight of between about 1500 and about 1800. The addition of ethylene oxide onto this hydrophobic part leads to an improvement in the solubility in water. The product is liquid up to a polyoxyethylene content of about 50% of the overall weight of the condensation product, which corresponds to a condensation with up to about 40 mol of ethylene oxide. Commercially available examples of this class of product are the Pluronic® grades from BASF and the ®Genapol PF grades from Clariant GmbH.

Condensation products of ethylene oxide with a reaction product of propylene oxide and ethylenediamine.

The hydrophobic unit of these compounds consists of the reaction product of ethylenediamine with excess propylene oxide and generally has a molecular weight of from about 2500 to 3000. Ethylene oxide is added onto this hydrophobic unit up to a content of from about 40 to about 80% by weight of polyoxyethylene and to a molecular weight of from about 5000 to 11,000. Commercially available examples of this class of compound are the ®Tetronic grades from BASF and the ®Genapol PN grades from Clariant GmbH.

Semipolar nonionic surfactants

This category of nonionic compounds comprises water-soluble amine oxides, water-soluble phosphine oxides and water-soluble sulfoxides, each having an alkyl radical of about 10 to about 18 carbon atoms. Semipolar nonionic surfactants include amine oxides of the formula

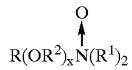

where R is an alkyl, hydroxyalkyl or alkylphenol group having a chain length of about 8 to about 22 carbon atoms, $R^2$ is an alkylene or hydroxyalkylene group having about 2 to 3 carbon atoms, or mixtures thereof, each radical $R^1$ is an alkyl or hydroxyalkyl group having about 1 to about 3 carbon atoms or a polyethylene oxide group having about 1 to about 3 ethylene oxide units, and x is a number from 0 to about 10. The $R^1$ groups can be linked to one another by way of an oxygen or nitrogen atom and can therefore form a ring. Amine oxides of this kind are, in particular, $C_{10}$–$C_{18}$-alkyldimethylamine oxides and $C_8$–$C_{12}$-alkoxyethyldihydroxyethylamine oxides.

Fatty acid amides

Fatty acid amides have the formula

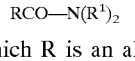

in which R is an alkyl group having about 7 to about 21, preferably about 9 to about 17, carbon atoms and each radical $R^1$ is hydrogen, $C_1$–$C_4$-alkyl, $C_1$–$C_4$-hydroxyalkyl or $(C_2H_4O)_xH$ where x varies from about 1 to about 3. Preference is given to $C_8$–$C_{20}$ amides, monoethanolamides, diethanolamides and isopropanolamides.

Further suitable nonionic surfactants are alkyl and alkenyl oligoglycosides and also fatty acid polyglycol esters or fatty amine polyglycol esters having in each case 8 to 20, preferably 12 to 18 carbon atoms in the fatty alkyl radical, alkoxylated triglycamides, mixed ethers or mixed formals, alkyl oligoglycosides, alkenyl oligoglycosides, fatty acid N-alkylglucamides, phosphine oxides, dialkyl sulfoxides and protein hydrolyzates.

Typical examples of amphoteric and zwitterionic surfactants are alkyl betaines, alkylamide betaines, aminopropionates, aminoglycinates or amphoteric imidazolinium compounds of the formula

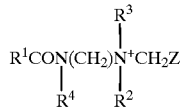

in which $R^1$ is $C_8$–$C_{22}$-alkyl or -alkenyl, $R^2$ is hydrogen or $CH_2CO_2M$, $R^3$ is $CH_2CH_2OH$ or $CH_2CH_2OCH_2CH_2CO_2M$, $R^4$ is hydrogen, $CH_2CH_2OH$ or $CH_2CH_2COOM$, Z is $CO_2M$ or $CH_2CO_2M$, n is 2 or 3, preferably 2, and M is hydrogen or a cation such as alkali metal, alkaline earth metal, ammonia or alkanolammonium.

Preferred amphoteric surfactants of this formula are monocarboxylates and dicarboxylates. Examples thereof are cocoamphocarboxypropionate, cocoamidocarboxypropionic acid, cocoamphocarboxyglycinate (alternatively referred to as cocoamphodiacetate) and cocoamphoacetate.

Other preferred amphoteric surfactants are alkyldimethyl betaines and alkyldipolyethoxy betaines with an alkyl radical having about 8 to about 22 carbon atoms, which can be linear or branched, preferably having 8 to 18 carbon atoms and, with particular preference, having about 12 to about 18 carbon atoms. These compounds are marketed, for example, by Clariant GmbH under the trade name ®Genagen LAB.

In special cases, the detergent and cleaning compositions may also contain cationic surfactants. Suitable cationic surfactants are substituted or unsubstituted straight-chain or branched quaternary ammonium salts of the type $R^1N(CH_3)_3^{\oplus}X^{\ominus}$, $R^1R^2N(CH_3)_2^{\oplus}X^{\ominus}$, $R^1R^2R^3N(CH_3)^{\oplus}X^{\ominus}$ or $R^1R^2R^3R^4N^{\oplus}X^{\ominus}$. The radicals $R^1$, $R^2$, $R^3$ and $R^4$ can preferably and independently of one another be unsubstituted alkyl having a chain length of between 8 and 24 carbon atoms, in particular between 10 and 18 carbon atoms, hydroxyalkyl having about 1 to about 4 carbon atoms, phenyl, $C_2$- to $C_{18}$-alkenyl, $C_7$- to $C_{24}$-aralkyl, $(C_2H_4O)_xH$, where x is from about 1 to about 3, alkyl radicals containing one or more ester groups, or cyclic quaternary ammonium salts. X is an appropriate anion.

Additional detergent and cleaning-product ingredients which may be included in the present invention comprise inorganic and/or organic builders in order to reduce the hardness of the water.

These builders can be present in proportions of from about 5% to about 80% by weight in the detergent and cleaning-product compositions. Inorganic builders include, for example, alkali metal, ammonium and alkanolammonium salts of polyphosphates, for instance tripolyphosphates, pyrophosphates and vitreous polymeric metaphosphates, phosphonates, silicates, carbonates, including bicarbonates and sesquicarbonates, sulfates and aluminosilicates.

Examples of silicate builders are the alkali metal silicates, especially those having an $SiO_2$:$Na_2O$ ratio of between 1.6:1 and 3.2:1, and also phyllosilicates, for example sodium phyllosilicates, as described in U.S. Pat. No. 4,664,839, obtainable from Clariant GmbH under the brand SKS®. SKS-6® is a particularly preferred phyllosilicate builder.

Aluminosilicate builders are particularly preferred for the present invention. These are, in particular, zeolites having the formula $Na_z[(AlO_2)_z(SiO_2)_y].xH_2O$, in which z and y are integers of at least 6, the ratio of z to y is between 1.0 and about 0.5, and x is an integer from about 15 to about 264.

Appropriate aluminosilicate-based ion exchangers are obtainable commercially. These aluminosilicates can be crystalline or amorphous in structure, and can be naturally occurring or else synthetically prepared. Processes for the preparation of ion exchangers based on aluminosilicate are described in U.S. Pat. No. 3,985,669 and U.S. Pat. No. 4,605,509. Preferred ion exchangers based on synthetic crystalline aluminosilicates are obtainable under the designation zeolite A, zeolite P(B) (including those disclosed in EP-A-0 384 070) and zeolite X. Preference is given to aluminosilicates having a particle diameter of between 0.1 and 10 $\mu$m.

Suitable organic builders include polycarboxy compounds, for example ether polycarboxylates and oxydisuccinates, as described for example in U.S. Pat. No. 3,128,287 and U.S. Pat. No. 3,635,830. Reference should likewise be made to "TMS/TDS" builders from U.S. Pat. No. 4,663,071.

Other suitable builders include the ether hydroxypolycarboxylates, copolymers of maleic anhydride with ethylene or vinyl methyl ether, 1,3,5-trihydroxybenzene-2,4,6-trisulfonic acid and carboxymethyloxysuccinic acid, the alkali metal, ammonium and substituted ammonium salts of polyacetic acids, for example ethylenediaminetetraacetic acid and nitrilotriacetic acid, and also polycarboxylic acids, such as mellitic acid, succinic acid, oxydisuccinic acid, polymaleic acid, benzene-1,3,5-tricarboxylic acid, carboxymethyloxysuccinic acid and soluble salts thereof.

Citrate-based builders, for example citric acid and its soluble salts, especially the sodium salt, are preferred polycarboxylic acid builders which can also be used in granulated formulations, especially together with zeolites and/or phyllosilicates.

Further suitable builders are the 3,3-dicarboxy-4-oxa-1,6-hexanedioates and the related compounds which are disclosed in U.S. Pat. No. 4,566,984.

If phosphorus-based builders can be used, and especially if the intention is to formulate soap bars for washing by hand, it is possible to use various alkali metal phosphates, for instance sodium tripolyphosphate, sodium pyrophosphate and sodium orthophosphate. It is likewise possible to use phosphonate builders, such as ethane-1-hydroxy-1,1-diphosphonate and other known phosphonates as are disclosed, for example, in U.S. Pat. No. 3,159,581, U.S. Pat. No. 3,213,030, U.S. Pat. No. 3,422,021, U.S. Pat. No. 3,400,148 and U.S. Pat. No. 3,422,137.

In a preferred embodiment of the invention the conventional cleaning product ingredients can be selected from components which are typical of those in cleaning compositions, such as surface-active substances and builders. If desired, the cleaning-product ingredients can include one or more cleaning auxiliaries or other materials which intensify the cleaning effect, which serve for treatment or care of the article to be cleaned, or which alter the service properties of the cleaning-product composition. Suitable cleaning auxiliaries in cleaning-product compositions include the substances specified in U.S. Pat. No. 3,936,537. The cleaning auxiliaries which can be used in the cleaning-product compositions of the present invention comprise, for example, enzymes, especially proteases, lipases and cellulases, foam boosters, foam limiters, antitarnish and/or anticorrosion agents, suspension agents, colorants, fillers, optical brighteners, disinfectants, alkalis, hydrotropic compounds, antioxidants, enzyme stabilizers, perfumes, solvents, solubilizers, antiredeposition agents, dispersants, color transfer inhibitors, for example polyamine N-oxides, such as poly(4-vinylpyridine N-oxide), polyvinylpyrrolidone, poly-N-vinyl-N-methylacetamide and copolymers of N-vinylimidazole and N-vinylpyrrolidone, processing auxiliaries, softeners and antistatic auxiliaries.

The detergent and cleaning-product compositions of the present invention can if desired include one or more conventional bleaches, and also activators or stabilizers, especially peroxy acids, which do not react with the soil release oligoesters of the invention. In general it must be ensured that the bleaches used are compatible with the cleaning-product ingredients. Conventional test methods, such as the determination of the bleaching activity of the ready-formulated cleaning composition as a function of storage time, can be used for this purpose.

The peroxy acid can be either a free peroxy acid or a combination of an inorganic persalt, for example sodium perborate or sodium percarbonate, with an organic peroxy acid precursor, which is converted to a peroxy acid when the combination of the persalt and the peroxy acid precursor is dissolved in water. The organic peroxy acid precursors are often referred to in the prior art as bleach activators.

Examples of suitable organic peroxy acids are disclosed in U.S. Pat. No. 4,374,035, U.S. Pat. No. 4,681,592, U.S. Pat. No. 4,634,551, U.S. Pat. No. 4,686,063, U.S. Pat. No. 4,606,838 and U.S. Pat. No. 4,671,891.

Examples of compositions suitable for bleaching laundry and containing perborate bleaches and activators are described in U.S. Pat. No. 4,412,934, U.S. Pat. No. 4,536,314, U.S. Pat. No. 4,681,695 and U.S. Pat. No. 4,539,130.

Examples of peroxy acids which are preferred for use in this invention include peroxydodecanedioic acid (DPDA), the nonylamide of the peroxysuccinic acid (NAPSA), the nonylamide of peroxyadipic acid (NAPAA) and decyldiperoxysuccinic acid (DDPSA). The peroxy acid is preferably contained within soluble granules in accordance with the method of U.S. Pat. No. 4,374,035. A preferred granular bleaching formulation comprises, in percent by weight, from 1% to 50% of a compound which is exothermically soluble, for example boric acid; from 1% to 25% of a surface-active ingredient compatible with the peroxy acid, for example C13LAS; from 0.1% to 10% of one or more chelate stabilizers, for example sodium pyrophosphate; and from 10% to 70% of a water-soluble salt, for example sodium sulfate.

The bleach, containing peroxy acid, is used in amounts which give rise to an available oxygen level of between about 0.1 % and about 10%, preferably between about 0.5% and about 5% and, in particular, from about 1% to 4%. The percentages are based on the overall weight of the cleaning-product composition.

Suitable amounts of the peroxy acid-containing bleach, based on one unit dose of the cleaning-product composition according to the invention, as used for a typical washing liquor comprising about 65 liters of water at from 15 to 60° C., produce between about 1 ppm and about 150 ppm of available oxygen, preferably between about 2 ppm and about 20 ppm of available oxygen. The washing liquor should have a pH of between 7 and 11, preferably between 7.5 and 10.5, in order to achieve adequate bleaching. Reference is made to column 6, lines 1 to 10 of U.S. Pat. No. 4,374,035.

Alternatively, the bleach composition can comprise an appropriate organic peroxy acid precursor which produces one of the abovementioned peroxy acids when it reacts in aqueous alkaline solution with hydrogen peroxide. The hydrogen peroxide source can be any inorganic peroxide which in aqueous solution releases hydrogen peroxide, such as sodium perborate (monohydrate and tetrahydrate) and sodium percarbonate.

The proportion of the peroxide-containing bleach in the novel cleaning-product compositions is between about 0.1% by weight and about 95% by weight and, preferably, between about 1% by weight and about 60% by weight. If the bleach composition is also a fully formulated cleaning-product composition, the content of the peroxide-containing bleach is preferably between about 1% by weight and about 20% by weight.

The amount of bleach activators that can be used with the soil release oligoesters of the invention is in general between 0.1 and 60% by weight, preferably between 0.5 and 40% by weight. If the bleach compositions used are at the same time fully formulated detergent compositions, then the amount of bleach activators present therein is preferably between about 0.5 and 20% by weight.

The peroxy acid and the soil release oligoesters of the invention are preferably in a weight ratio of available oxygen from the peroxy acid to soil release oligoester of the invention of from about 4:1 to about 1:30, in particular from about 2:1 to about 1:15 and, specifically, from about 1:1 to about 1:7.5. This combination can be used either as a fully formulated product or else as an additive to a detergent.

The detergent and cleaning-product compositions of the invention can comprise one or more conventional enzymes which do not react with the novel soil release oligoesters of this invention. A particularly preferred enzyme is cellulase. The cellulase used in this case can be obtained from bacteria or fungi and should have an optimum pH range of between 5 and 9.5. Suitable cellulases are disclosed in U.S. Pat. No. 4,435,307. The cellulase in question is produced from a strain of Humicola insolens, especially from the strain Humicola DSM 1800 or another cellulase-212-producing fungus belonging to the genus Aeromonas, and also cellulase extracted from the hepatopancreas of certain marine mollusks. Suitable cellulases are likewise disclosed in GB-A-2,075,028, GB-A-2,085,275 and DE-A-2,247,832.

Preferred cellulases are described in WO-91/17243. The cleaning-product compositions of the invention contain enzymes in amounts of up to about 50 mg, preferably from about 0.01 mg to about 10 mg per gram of the cleaning-product composition. Based on the weight of the detergent and cleaning-product compositions which comprise the soil release oligoesters of the invention, the proportion of enzymes is at least 0.001% by weight, preferably between about 0.001% and about 5% by weight, in particular from about 0.001% by weight to about 1% by weight and, specifically, from about 0.01% by weight to about 1% by weight.

EXAMPLES

Example 1

1000 g of a sec. alkanesulfonate (commercial product ®Hostapur SAS 93 pellets) were thoroughly mixed with 10 g of calcium stearate and then ground on a beater wheel mill without internals at a product throughput of 55 kg/h. This gave readily flowable granules having the following particle size distribution:

| | |
|---|---|
| 0.1–0.6 mm | 18% |
| 0.6–1.0 mm | 34% |
| 1.0–2.0 mm | 33% |
| >2.0 mm | 15% |

Example 2

1000 g of sec. alkanesulfonate as in Example 1 were thoroughly mixed with 10 g of silica (Sipernat® 22 S) and then ground on a beater wheel mill without internals at a product throughput of 60 kg/h. This gave readily flowable granules having the following particle size distribution:

| | |
|---|---|
| 0.1–0.6 mm | 25% |
| 0.6–1.0 mm | 46% |
| 1.0–2.0 mm | 19% |
| >2.0 mm | 10% |

Example 3

1000 g of sec. alkanesulfonate as in Example 1 were thoroughly mixed with 10 g of calcium stearate and then ground on a bench screen cage mill (universal mill with cross-beater) at a product throughput of 70 kg/h. The diameter of the holes in the screen cage was 6 mm. Readily flowable granules having a bulk density of 519 g/l and the following particle size distribution were obtained:

| | |
|---|---|
| 0.1–0.6 mm | 43% |
| 0.6–1.0 mm | 48% |
| 1.0–2.0 mm | 9% |

Example 4

Example 3 was repeated but using Mg stearate as additive instead of Ca stearate. The resulting readily flowable granules had a bulk density of 519 g/l and the following particle size distribution:

| | |
|---|---|
| 0.1–0.6 mm | 26% |
| 0.6–1.0 mm | 64% |
| 1.0–2.0 mm | 10% |

Example 5

1000 g of sec. alkanesulfonate as in Example 1 were mixed with 20 g of a 1:1 premix of magnesium oxide and magnesium silicate. The resulting pellets were ground on a bench screen cage mill having a hole width of 8 mm and a product throughput of 40 kg/h. Readily flowable granules having the following grain size distribution were obtained:

| | |
|---|---|
| 0.1–1.0 mm | 39% |
| 1.0–2.0 mm | 58% |
| >12 mm | 3% |

Example 6

5000 g of sec. alkanesulfonate as in Example 1 were premixed with 50 g of hydrophobic silica (Sipernat D 17) and ground on a bench screen cage mill having a hole width of 6 mm and a product throughput of 60 kg/h. The resulting granules had the following grain size distribution:

| | |
|---|---|
| 0.1–1.0 mm | 81% |
| 1.0–2.0 mm | 19% |

Example 7

5000 g of sec. alkanesulfonate as in Example 1 were treated with 100 g of hydrophilic silica (Sipernat® 22 S) and ground as described in Example 3. The bulk density of the readily flowable granules was 532 g/l. Screen analysis produced the following grain size distribution:

| | |
|---|---|
| 0.1–1.0 mm | 88% |
| 1.0–2.0 mm | 12% |

Example 8

Secondary alkanesulfonate was mixed with 1% by weight of silica (Sipernat D 17) and ground on a Pallmann mill (Pallmann PP6 mill with screen cage and turbines). The screen cage consists of a perforated sheet having 6 mm rectangular holes. The product throughput was 500 kg/h. The bulk density of the readily flowable granules was 590 g/l. Screen analysis gave the following particle size distribution:

| | |
|---|---|
| 0.1–1.0 mm | 95% |
| 1.0–2.0 mm | 5% |

Patent claims:

1. A ground, finely divided granular secondary alkanesulfonate product, comprising ground coarse, solid secondary alkanesulfonate and an non-hygroscopic additive selected from the group consisting of fatty acids, fatty salts, fatty alcohols, polymers, celluloses, derivatives of celluloses, waxes, bentonites, magnesium oxide, chalk, kaolin, magnesium silicate, siliceous chalk, kieselguhr, and talc, said product obtained by (a) grinding coarse secondary alkanesulfonate followed by mixing with said additive, or (b) grinding a mixture of coarse secondary alkanesulfonate and said additive, said product having a particle size of from 0.1 to 3 mm.

2. The granular secondary alkanesulfonate product as claimed in claim 1 wherein in (a), said grinding of coarse secondary alkanesulfonate and said mixing with said additive is carried out simultaneously.

3. A granular secondary alkanesulfonate as claimed in claim 1, comprising 0.1 to 10% by weight of the additive, based on the amount of secondary alkanesulfonate.

4. A pulverulent detergent and cleaning product composition comprising a granular secondary alkanesulfonate as claimed in claim 1.

5. An extrudate, pressed article or compact, comprising a granular secondary alkanesulfonate as claimed in claim 1.

6. The granular secondary alkanesulfonate product as claimed in claim 1 wherein said mixture in (b) is made prior to said grinding.

* * * * *